US010056215B1

(12) United States Patent
Garvin

(10) Patent No.: US 10,056,215 B1
(45) Date of Patent: Aug. 21, 2018

(54) UNIVERSAL ADJUSTABLE ELECTRICAL CIRCUIT BREAKER LOCKING DEVICE

(71) Applicant: Barton L. Garvin, Western Springs, IL (US)

(72) Inventor: Barton L. Garvin, Western Springs, IL (US)

( * ) Notice: Subject to any disclaimer, the term of this patent is extended or adjusted under 35 U.S.C. 154(b) by 0 days.

(21) Appl. No.: 15/480,085

(22) Filed: Apr. 5, 2017

(51) Int. Cl.
*H01H 9/28* (2006.01)
*H01H 71/10* (2006.01)

(52) U.S. Cl.
CPC ..... *H01H 71/1054* (2013.01)

(58) Field of Classification Search
CPC .... H01H 71/1054; H01H 71/00; H01H 71/02; H01H 71/0214; H01H 71/0264; H01H 71/10; H01H 71/50; H01H 71/1018; H01H 2300/018; H01H 2071/10; H01H 2071/1009; H01H 9/20; H01H 9/26; H01H 13/72; H01H 13/76
USPC ..... 200/43.21
See application file for complete search history.

(56) References Cited

U.S. PATENT DOCUMENTS

| | | | | |
|---|---|---|---|---|
| 4,347,412 | A | 8/1982 | Mihara et al. | 200/42 |
| 5,079,390 | A | 1/1992 | Costanzo et al. | 200/43.14 |
| 5,147,991 | A | 9/1992 | Jordan, Sr. | 200/43.14 |
| 5,648,646 | A * | 7/1997 | Flegel | H01H 9/26 200/50.32 |
| 6,541,719 | B1 * | 4/2003 | Powell | H01H 71/1018 200/50.32 |
| 6,861,596 | B2 * | 3/2005 | Schnackenberg | H01H 9/26 200/43.01 |
| 8,678,625 | B2 | 3/2014 | Garvin | 362/369 |
| 8,937,259 | B2 | 1/2015 | Garvin | 200/43.21 |

* cited by examiner

*Primary Examiner* — Anthony R. Jimenez
(74) *Attorney, Agent, or Firm* — David G. Rosenbaum; Benjamin D. Rotman; Rosenbaum IP, P.C.

(57) ABSTRACT

A universal adjustable breaker lock device for a switch handle includes at least two locking members each having a channel adapted to accommodate the switch handle. The locking members are coupled to a translation member allowing the locking members to translate along a longitudinal axis of the translation member. A lever arm extends from a base wall or the translation member a distance greater than the width of the channel. In alternate embodiments, a cover, with two apertures, is disposed on the lever arm, to prevent engagement with a fastener. In the alternative embodiment, a lock may be disposed through the apertures to prevent removal of the universal breaker lock device while in use.

10 Claims, 6 Drawing Sheets

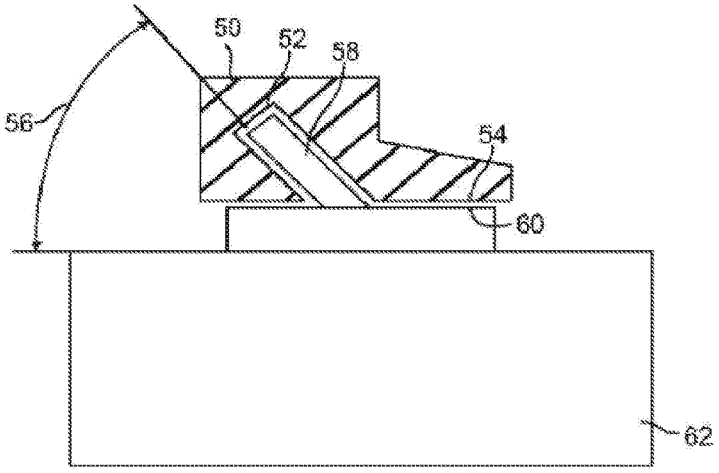
FIG. 1 - Prior Art
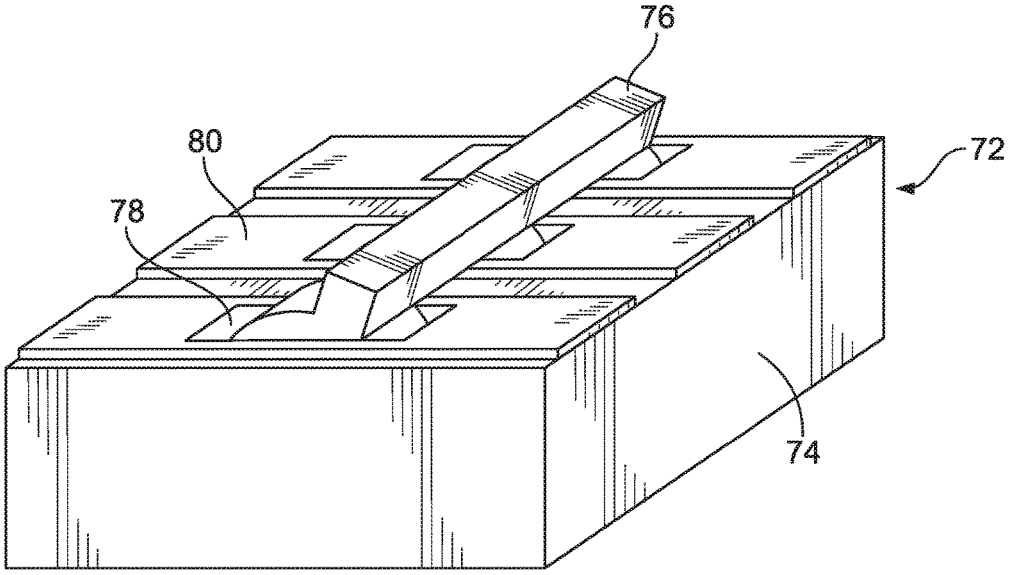
FIG. 2A

UNIVERSAL ADJUSTABLE ELECTRICAL CIRCUIT BREAKER LOCKING DEVICE

BACKGROUND OF THE INVENTION

In some circumstances it may be necessary to restrain a switch from being turned on or off. For example, rules promulgated by the Occupational Safety and Health Administration (OHSA) require an electrical circuit breaker to be "locked-out," i.e., restrained from being switched from an off position to an on position, for safety purposes to allow an individual to repair or install electrical equipment powered via the circuit breaker.

A variety of devices for restraining individual circuit breaker switches exist conventionally. Examples of such devices are disclosed in U.S. Pat. No. 4,347,412 and U.S. Pat. No. 8,598,477.

Manufacturers may design the housing and switch handle of a circuit breaker switch such that only their respective restraint devices can interface therewith. For example, the housing may have a lip, groove, or ridge at a fixed distance from the switch handle such that the manufacturer's restraint device may be compatible with the circuit breaker switch, but restraint devices produced by competing manufacturers may not. A risk exists that an individual may place an incompatible restraint device on a circuit breaker resulting in failure of the restraint device and potential injury to the individual. Another problem with available switch restraint devices is their bulkiness. U.S. Pat. Nos. 5,079,390 and 5,147,991 each disclose a circuit breaker restraint device having a member whose width is equal to that of a switch handle. The large size of these restraint devices requires a significant amount of material and raises the cost of the restraint device. Moreover, the size of such devices may impede the ability of a user to close the outer door to the circuit breaker box. A need, therefore, exists for a universal switch restraint device that can be used without modification with a multiplicity of brands of circuit breakers.

SUMMARY OF THE INVENTION

The present invention relates to the field of electrical systems and repairs thereof. In particular, the present invention relates to a device that can be secured to a switch handle to inhibit the handle from moving relative to the switch.

In one aspect of the invention, a universal adjustable breaker lock device for a switch handle that projects through an aperture in a switch housing is presented. The universal adjustable breaker lock device comprises at least two locking members. Each locking member may be similar to the device presented in U.S. Pat. No. 8,678,625 incorporated in its entirety herein. Each locking member having a collar member forming a channel therethrough and adapted to engage the switch handle. The at least two locking members are further coupled to a translation member configured to allow the at least two locking members to translate along a longitudinal axis of the translation member to accommodate a width of the switch handle. A blocking member extends from either or each of the collar members or from the translation member and is configured to contact the switch housing external to the aperture when the collar member engages the switch handle. In some embodiments, a cover member similar to the cover member used on devices disclosed in U.S. Pat. No. 8,937,259, incorporated its entirety herein, is attached to the blocking member, and has open ends. The cover member further includes a pair of apertures disposed opposite each other. A lock can be disposed through the pair of apertures.

In another aspect of the invention, a universal adjustable breaker lock device for a switch handle is presented. The universal adjustable breaker lock device comprises at least two locking members. Each locking member may be similar to the device presented in U.S. Pat. No. 8,678,625. Each locking member having a channel adapted to accommodate the switch handle and having first and second planar ends. The at least two locking members are further coupled to a translation member configured to allow the at least two locking members to translate along a longitudinal axis of the translation member to accommodate a width of the switch handle. A lever arm extends from each channel or the translation member a distance greater than the greatest dimension measured transversely across the channel. In some embodiments, a cover member similar to the devices in U.S. Pat. No. 8,937,259 is attached to the lever arm, and has open ends. The cover member further includes a pair of apertures disposed opposite each other. A lock can be disposed through the pair of apertures.

BRIEF DESCRIPTION OF THE DRAWINGS

In the accompanying figures, like elements are identified by like reference numerals among the several preferred embodiments of the present invention.

FIG. 1 is cross-sectional view of a restraint device disclosed in the prior art.

FIG. 2A is an isometric view of a conventional electrical circuit breaker switch.

Other aspects and advantages of the present invention will become apparent upon consideration of the following detailed description, wherein similar structures have similar reference numerals.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 2B:
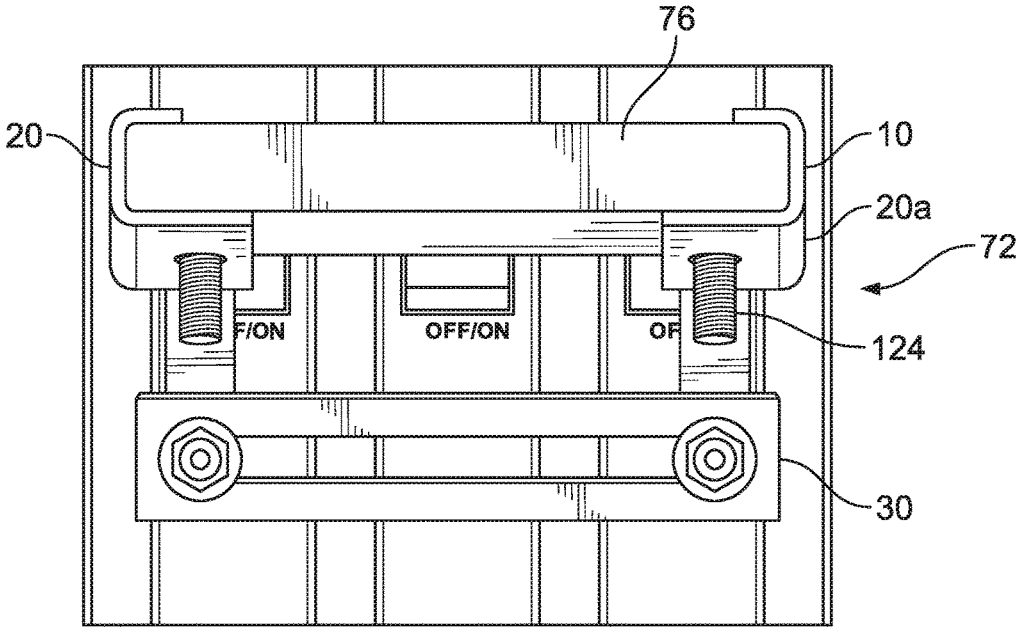
FIG. 2B is a front view of the universal adjustable electrical circuit breaker lock device installed onto an electrical circuit breaker switch.
Figure 2C:
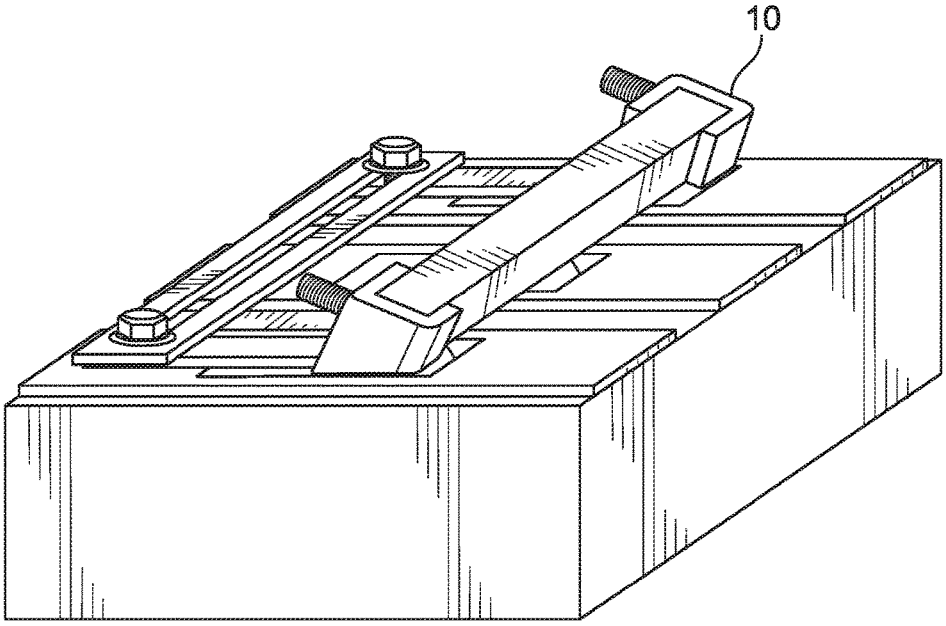
FIG. 2C is a perspective view of the universal adjustable electrical circuit breaker lock device installed onto an electrical circuit breaker switch.

With reference to the drawings, FIGS. 2A-2C represent a standard switch 72 and switch handle 76 an embodiment of a universal adjustable breaker lock device 10 installed onto a switch handle and FIGS. 3A-3D represent additional embodiments of a universal adjustable breaker lock device 10. The universal adjustable breaker lock device 10 comprises at least two locking members 20, 20*a* coupled to a translation member 30 configured to translate about the translation member 30 to accommodate the width of the switch handle 76.

Referring to FIG. 2B, in one embodiment of the present invention, a universal adjustable breaker lock device 10 engages an electrical switch 72 that includes a switch housing 74 and a switch handle 76. The switch handle 76 extends through an aperture 78 (see FIG. 2A) disposed through a switch panel 80 on a side of the switch housing 74. The switch panel 80 may have any shape as known in the art, for example, the switch panel 80 may have a generally rectangular planar shape, as illustrated in FIGS. 2A-2C. In operation, the electrical switch 72 may be inserted into a circuit breaker board (not shown) such that only the switch panel 80 is exposed. The switch handle 76 is adapted to be moved by a user between ON and OFF positions (see FIG. 2A). Movement of the switch handle 76 between the ON and OFF positions may consist of either rotation and/or translation relative to the switch housing 74.

Referring now to FIGS. 3A-3D, the universal adjustable breaker lock device 10 includes at least two locking members 20, 20*a*. The locking members 20, 20*a* each include a collar member 82, 82*a* adapted to receive the switch handle 76 such that they substantially or wholly surround at least a portion of the switch handle 76 when deployed. In some embodiments a first locking member 20 is positioned at a first end of the switch handle 76 while a second locking member 20*a* is positioned at a second end of the switch handle 76. In other embodiments, as displayed in FIG. 3D, a third locking member 22*c* or additional locking members may be placed intermediate the first and second locking device to provide additional support.

Figure 3A:
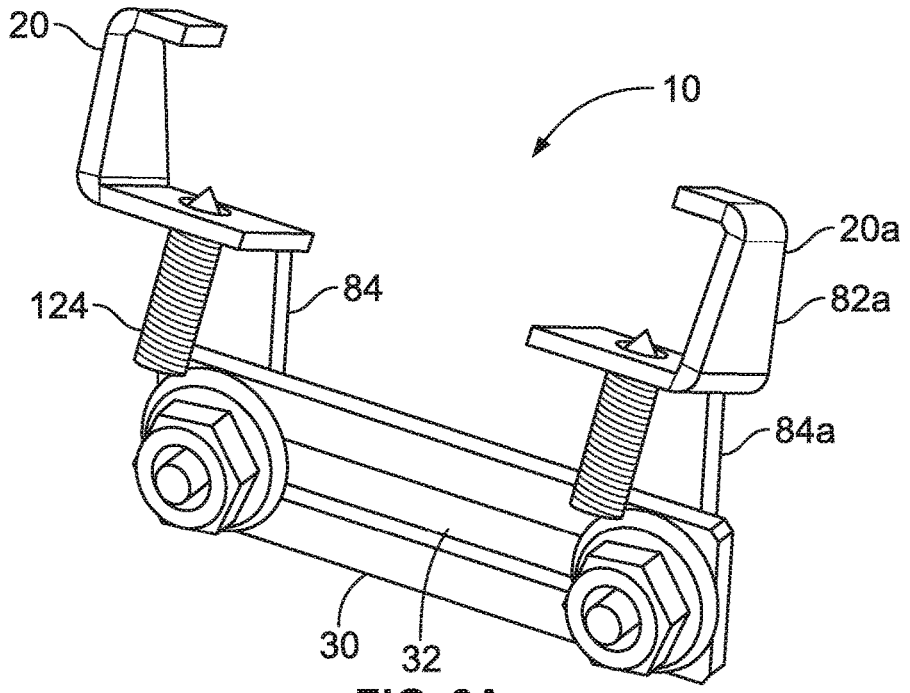
FIG. 3A is a perspective view of an embodiment of the universal adjustable electrical circuit breaker lock device.

In one embodiment shown in FIG. 3A, the locking members 20, 20*a* each further include a blocking member or lever arm 84, 84*a* attached to the collar member 82, 82*a*. The blocking member 84, 84*a* may be integral with the collar member 82, 82*a* or may be manufactured as a separate component and subsequently attached to the collar member 82, 82*a* using any common method of attachment as known in the art, including, without limitation, by welding or use of fasteners directly connecting the two components, one to the other, or indirectly by attachment of each to a single bracket. The blocking member or lever arm 84, 84*a* may comprise a generally rectangular shape.

Figure 3B:
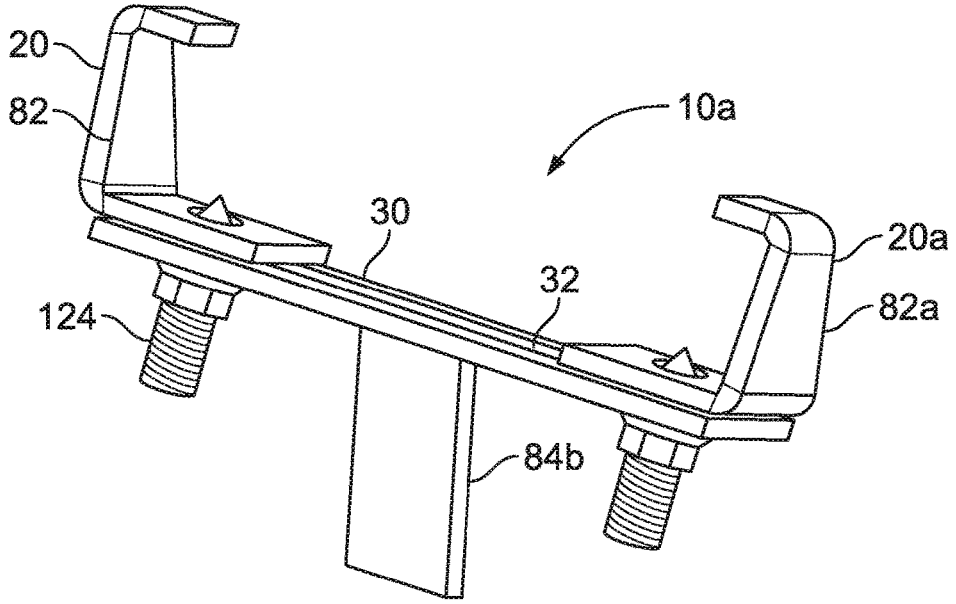
FIGS. 3B-D are perspective views of additional embodiments of the universal adjustable electrical circuit breaker lock device.
Figure 3C:
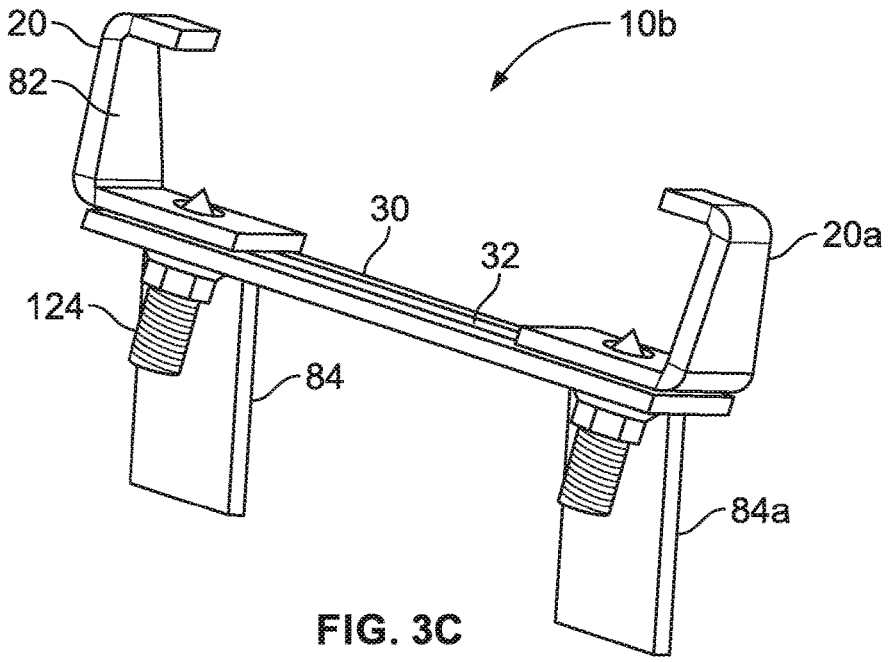

In an additional embodiment 10*a* as shown in FIG. 3B, the blocking member or lever arm 84*b* may be coupled to the translation member 30 instead of or in addition to the locking members 20, 20*a*. In this embodiment, the blocking member 84*b* may be integral with the translation member 30 or may be manufactured as a separate component and subsequently attached to the translation member 30 using any common method of attachment as known in the art, including, without limitation, by welding or use of fasteners directly connecting the two components, one to the other, or indirectly by attachment of each to a single bracket.

In FIG. 3A, the locking members 20, 20*a* are coupled to the translation member 30 through the blocking members 84, 84*a*. The blocking members 84, 84*a* may be coupled to the translation member 30 through use of common fasteners including, but not limited to, screws, nuts, bolts, snaps, threaded members that extend from the blocking members 84, 84*a* or magnets. In the example embodied by FIG. 3A, nuts and bolts are used to couple the blocking members to the translation member 30 through a slot 32 in the translation member 30. When the nuts are left untightened, the locking members are free to translate longitudinally along the slot 32 of the translation member 30 to accommodate the size of switch to be locked. After the appropriate size is achieved, the nuts may be tightened to lock the locking members 20, 20*a* in position within the slot 32 of the translation member 30. In other embodiments 10*b* and 10*c* exemplified by FIGS. 3B and 3C, the translation member is coupled directly to the collar members of the locking members 30 through use of common fasteners including, but not limited to, screws, nuts, bolts, snaps or magnets. In the example embodied by FIGS. 3B and 3C, nuts and bolts are used to couple the collar members to the translation member 30 through the slot 32 in the translation member 30. When the nuts are left untightened, the locking members are free to translate longitudinally along the slot 32 of the translation member to accommodate the size of switch to be locked. After the appropriate size is achieved, the nuts may be tightened to lock the locking members in position within the slot 32 of the translation member. In additional embodiments, slot 32 may be replaced by a plurality of openings to move and set the locking members 20, 20*a* to predetermined positions to accommodate industry standard switches, or a magnet or series of magnets to magnetically engage the locking members 20, 20*a* into the appropriate position.

The locking members 20, 20*a*, blocking members 84, 84*a*, and translation member 30 may be manufactured from any suitable material conventionally used to make fasteners, such as, without limitation intended, steel, stainless steel, copper, aluminum alloy, polyethylene, polyvinyl chloride, and polypropylene. The locking members 20, 20*a*, blocking members 84, 84*a*, and translation member 30 may be manufactured by a single continuous piece of material. A non-conducting material may be used to form the locking members 20, 20*a* in order to reduce the risk of electrical shock. The material usefully employed for the fasteners is suitable to the extent that it exhibits similar integrity and strength as are associated with the above-identified materials.

Figure 3D:
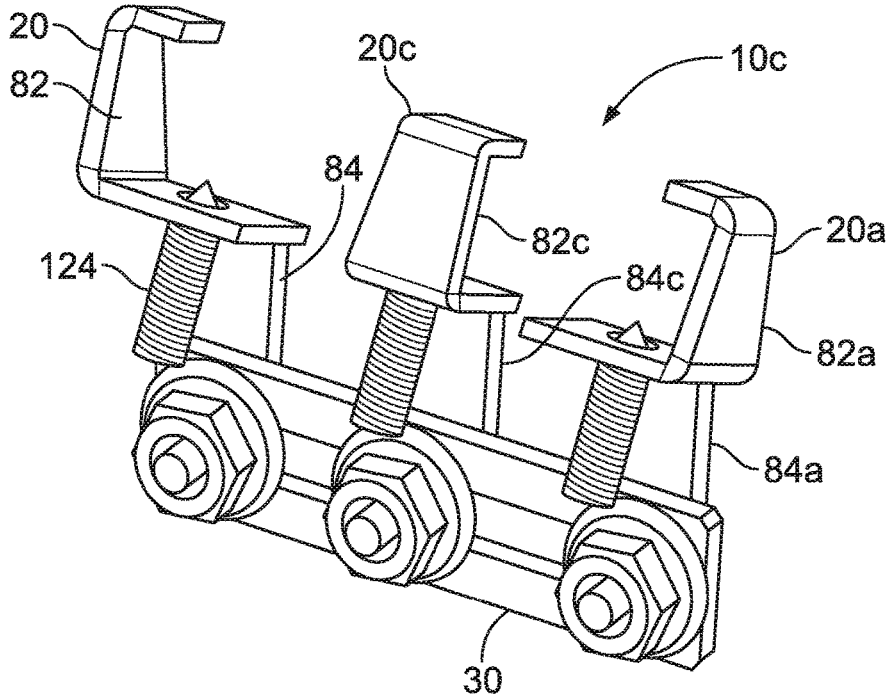
Figure 4C:
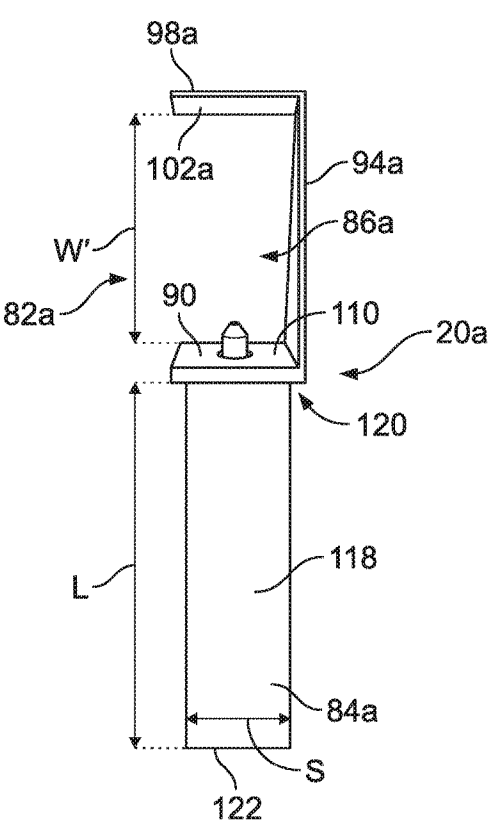
FIGS. 4A-C are representative views of the universal adjustable electrical circuit breaker lock device locking member.
Figure 4A:
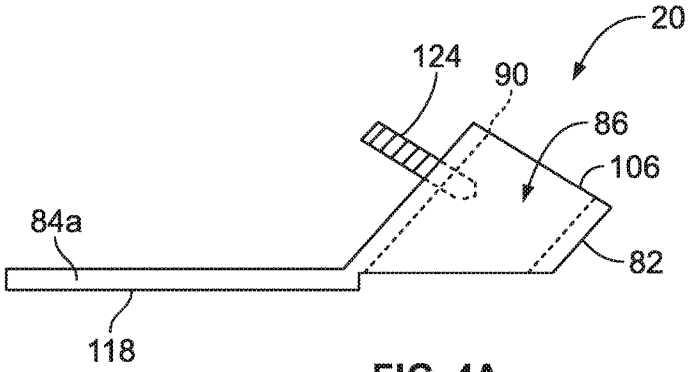
Figure 4B:
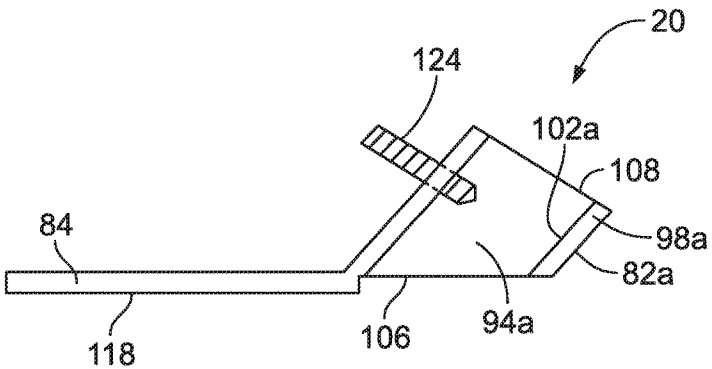
Figure 5:
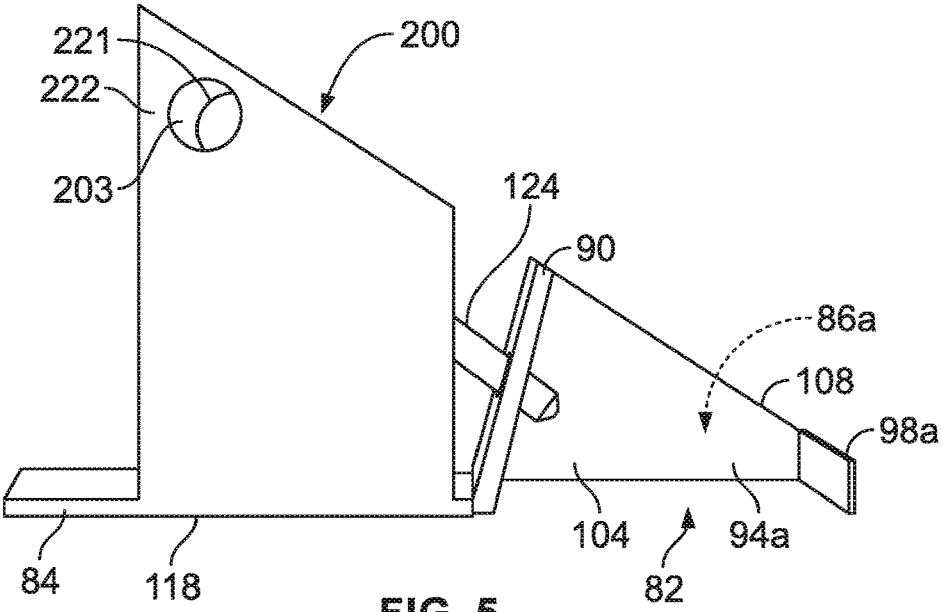
FIG. 5 is side view of a universal adjustable electrical circuit breaker lock device locking member with a cover member.

Referring to any of the embodiments of FIGS. 3A-3D, and further detailed in FIGS. 4A and 4B, each locking member 20, 20*a* includes a collar member 82, 82*a* that defines a channel 86, 86A that partially surrounds the switch handle 76 upon engagement with the switch handle 76. The respective channels for each locking member leave opposite sides open such that the first locking member 20 can engage the first end of the switch handle 76 while the second locking member 20*a* can engage the second end of the switch handle 76. Once the universal adjustable breaker lock device 10 is secured to the switch handle 76 by means, for example, of fastener 124, then the switch handle 76 is impeded from switching from whichever position it was in to its opposite position.

Referring to FIGS. 4A-4C, the channel 86, 86*a* of the collar member 82, 82*a* is defined by the base wall 90, a side wall 94, 94*a* that extends generally perpendicularly from the base wall 90, and a top wall 98*a* that extends generally perpendicularly from a distal end of the side wall 94*a*. The channel 86, 86*a* includes first and second ends 106, 108 that are each generally planar. In one embodiment, the blocking member 84, 84*a* extends from the base wall 90 substantially parallel to the first end 106 of the channel 86, 86*a*. The channel 86, 86*a* of the collar member 82, 82*a* may be dimensioned to form a press fit with the switch handle 76 via flush contact between the surfaces 88 and 110 and between the surface 104 and an interior surface 102*a* of the top wall 98*a*.

In some embodiments that use at least a third locking member placed intermediate the first and second end locking members, the at least third locking member, as shown in FIG. 3D, may be configured to have a channel that covers the top, bottom, and front surfaces of the switch handle. In this embodiment, the channel 86*c* of the collar member 82*c* is defined by the base wall 90*c*, a front wall 94*c* that extends generally perpendicularly from the base wall 90, and a top wall 98*c* that extends generally perpendicularly from a distal end of the front wall 94*b*. The channel 86*c* includes first and second ends 106*c*, 108*c* that are each generally planar. In one embodiment, the blocking member 84*c* extends from the base wall 90*c* substantially parallel to the first end 106*c* of the channel 86*c*. The channel 86*c* of the collar member 82*c* may be dimensioned to form a press fit with the switch handle 76 via flush contact between the top, front and bottom surfaces of the switch handle and between the surface 104 and an interior surface 102*b* of the top wall 98*b*.

Referring to FIGS. 2-5, the blocking member 84, 84*a* includes a contact surface 118 that is adapted to make substantial contact with the switch panel 80 external to the aperture 78. Accordingly, the contact surface 118 may be substantially planar and may have any shape as desired, for example, a generally rectangular shape as illustrated in FIGS. 3A-3D. The surface 118 is generally parallel to the switch panel 80 when the universal breaker lock device 10 engages the electrical switch 72.

The blocking member 84, 84*a* extends away from the collar member 82, 82*a*, or the translation member 30 generally in the direction of motion of the switch handle 76 that the universal adjustable breaker lock device 10 is configured to prevent. The blocking member 84, 84*a* has a long dimension or length, L, measured between a proximal end 120 attached to the base wall 90 and a distal end 122 of the blocking member 84, 84*a*. The channel 86, 86A has a greatest internal dimension measured transversely across the channel 86, 86A between opposite internal surfaces thereof. For example, the greatest transverse internal dimension of the channel 86, 86A may be a width, W, measured between the interior surfaces 112, 114 of the side walls 92, 94, as illustrated in FIGS. 4A-4C. Similarly, the channel 86, 86A may, for example, have a greatest internal dimension, W', measured transversely across the channel 86, 86Aa between the surface 110 and the interior surface 102*a* of the top wall 98*a*, as illustrated in FIG. 4C.

The length L of the blocking member 84, 84*a* is configured to be a length greater than the greatest transverse internal dimension W' of the channel 86, 86*a*. This configuration provides a blocking member sufficiently long to make contact with the switch panel 80 exterior to the aperture 78 so long as the channel 86, 86*a* fits over the switch handle 76. Furthermore, more contact between the blocking member 84, 84*a* and the switch panel 80 may increase friction therebetween and prevent slippage of the universal adjustable breaker lock device 10 relative to the electrical switch 72.

The blocking member 84, 84*a* has a short dimension, S, measured transverse to the long dimension L. The short dimension, S, may be configured to be less than the greatest transverse internal dimension of the channel 86, 86Aa, as illustrated in FIGS. 4A-C. This configuration may be useful in application of multiple adjustable universal breaker lock devices 20, 22*a* to multiple electrical switches 72 that are arranged next to one another within a confined space.

In other embodiments, in addition to or instead of being configured substantially parallel to the first end 106, the blocking member 84, 84*a* may form an angle with the first end 106. An angled blocking member 84, 84*a* may be useful in some circumstances given the geometry and/or contours of the switch housing 74, which may vary between brands of electrical switches 72.

In some embodiments, the universal adjustable breaker lock device 10 further includes a cover member 200, which is attached to the blocking member 84, 84*a* and has open ends. The cover member 200 has side walls with outer surfaces 201, 202 and inner surfaces 203, 204. The cover member 200 also has top surface 205. In some embodiments, the cover member may further include a structure that facilitates addition of an external locking device, such as a keyed or combination lock, to the cover member to further limit access for removal of the breaker lock device. As illustrated in FIG. 5A, the cover member 200 further includes a pair of apertures 221, 222 disposed opposite each other. The apertures are disposed through the cover member side wall outer surfaces 201, 202 and inner surfaces 203, 204. The hasp of a lock of suitable size can be disposed through both apertures 220, 221. When the hasp of the lock is disposed through both apertures 220, 221, adjustment of the fastening means 124 is prevented (see FIG. 6). This serves to prevent accidental or intentional adjustments of the fastening means 124 resulting in an undesired removal of the universal breaker lock device 10, thereby permitting an undesired change in the setting of the switch handle 76.

Not wishing to be bound by theory, the blocking member 84, 84*a* acts as lever arms that provide a reaction moment in response to rotational movement of the switch handle 76. Any force applied to move the switch handle 76 from the ON position to the OFF position (or vice versa depending on the configuration of the universal adjustable breaker lock device 10 and switch handle 76) causes the switch panel 80 to produce an equal and opposite reaction force in the blocking member 84, 84*a* that substantially eliminates movement of the switch handle 76. The blocking member 84, 84*a* transfers this reaction force to the switch handle 76 via the collar member 82, 82*a*, which operatively grips the switch handle 76 when a force is applied to move the switch handle 76. The translation member 30 aides in providing additional support and stability to the device when applied to a wide switch handle 76.

The interior surface 110 of the base wall 90 may contact the surface 88 of the switch handle 76. The interior surface 110 may be positionally adjustable such that an interior dimension measured between the interior surface 110 and surfaces 102*a* may be altered to allow the collar member 82, 82*a* to be able to universally grip a variety of switch handles 76 having a variety of shapes and sizes.

Alternatively, an adjustable fastener 124, such as, for example, a set screw, may extend through a threaded aperture 126 disposed through the base wall 90 and impinge the surface 88 of the switch handle 76. The distance that the fastener 124 extends into the channel 86, 86*a* may be adjusted by rotating the fastener 124 through the threaded opening 126. The fastener 124 creates friction between the collar member 82, 82*a* and the switch handle 76 to increase the effectiveness of the grip there between. Additionally, the fastener 124 transfers the hereinabove described reaction force produced in the blocking member 84, 84*a* to the surface 88 of the switch handle 76 thereby inhibiting movement of the switch handle 76.

Figure 6:
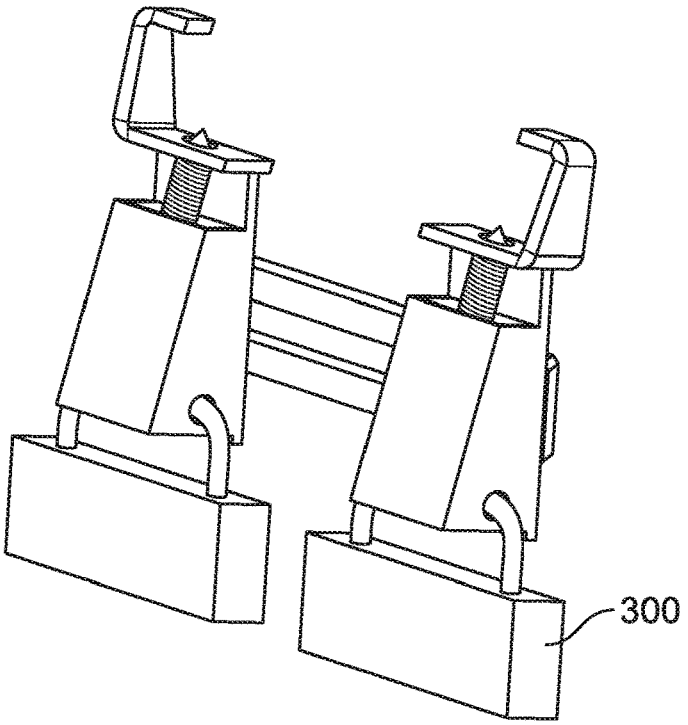
FIG. 6 is a side elevational view of another embodiment of the universal electrical circuit breaker lock device.

The adjustability of the fastener 124 allows the universal adjustable breaker lock device 10 to be operational with a multiplicity of available brands of electrical switches 72 having a switch handle 76 as wide as the maximum size of the translation member. The fastener 124 may be fixed in a predetermined position relative to the collar member 82, 82*a* by a locking mechanism as described in U.S. Pat. Nos. 5,079,390 and 5,147,991, which are hereby incorporated by reference in their entireties. FIG. 6 depicts another embodiment of the universal adjustable breaker lock device 10, where the hasp of a lock means 300 is engaged through the apertures of the cover means 200 to prevent intentional or unintentional adjustment to the fastener means. The lock means may be any lock means as known in the art, including padlocks, key locks, and/or the like, having a shaft or hasp that can pass through the apertures in the cover and be locked in place.

The adjustability of the universal adjustable breaker lock device 10 not only allows for utility on a wide range of switch handle shapes and sizes but also allows a user to quickly and simply restrain an electrical switch from being actuated. This flexibility and ease of installation may save time in comparison to more complex devices intended only for tamper proof or more permanent installation. The universal adjustable breaker lock device 10 described hereinabove may require less material to manufacture than known larger and bulkier breaker lock devices, thereby providing an economical benefit in cost of material. Further, the open nature of the second end 108 of the channel 86, 86*a* allows a user to see indicia such as brand, model, or amperage rating that may be printed or embossed on a distal end of the switch handle 76.

While the present invention may be embodied in many forms, multiple embodiments are discussed herein with the understanding that embodiments illustrated are to be considered only as an exemplification of the invention and are not intended to limit the disclosure to the embodiments illustrated. For example, although the universal adjustable breaker lock device 10 is described hereinabove with regard to a circuit breaker switch, the universal restraint device 10 is also operable with wall mounted light switches. Further, it should be understood that the universal adjustable breaker lock device 10 is not limited to use with electrical switches. The universal adjustable breaker lock device 10 can be dimensioned to operate with any manual switch adapted to be selectively displaced in an ON or OFF position. It should be understood that the universal adjustable breaker lock device 10 can engage a switch in both an upright and inverted position to prevent downward and upward movement, respectively, of the switch handle 76.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

I claim:

1. A universal adjustable electrical circuit breaker lock device comprising:

a. a first locking member having a first channel and having first and second planar ends, wherein the channel comprises a base wall, a side wall that extends generally perpendicularly from the base wall, a top wall that extends generally perpendicularly from a distal end of the side wall, such that the ends of the top and base walls opposite the side wall have an open gap therebetween, and a lever arm extending from the channel a distance greater than the greatest dimension measured transversely across the channel; and b. at least a second locking member having a second channel and having first and second planar ends, wherein the channel comprises a base wall, a side wall that extends generally perpendicularly from the base wall, a top wall that extends generally perpendicularly from a distal end of the side wall, such that the ends of the top and base walls opposite the side wall have an open gap therebetween, and a second lever arm extending from the channel a distance greater than the greatest dimension measured transversely across the channel; and c. a translation member having a longitudinal axis; and wherein the first locking member and the at least a second locking member are coupled to the translation member through a slot or a plurality of openings in the translation member or are magnetically engaged to the translation member and configured to translate along the longitudinal axis of the translation member.

2. The universal adjustable breaker lock device of claim 1, wherein a surface of the lever arm or second lever arm is substantially parallel to a switch housing external to a switch housing aperture when the first channel or second channel engages a switch handle of an electrical circuit breaker.

3. The universal adjustable breaker lock device of claim 1, wherein a switch handle of an electrical circuit breaker extends entirely through the first channel or second channel when the first channel or second channel engages the switch handle.

4. The universal adjustable breaker lock device of claim 1, wherein the lever arm or second lever arm has a long dimension greater than the greatest dimension measured transversely across the channel between opposite surfaces thereof.

5. The universal adjustable breaker lock device of claim 1, wherein the lever arm or second lever arm has a short dimension less than the greatest dimension measured transversely across the channel between opposite interior surfaces thereof.

6. The universal adjustable breaker lock device of claim 1 wherein the universal adjustable breaker lock device further comprises an additional removable fastener securing the first channel or second channel to a switch handle of an electrical circuit breaker.

7. The universal adjustable breaker lock device of claim 1 wherein a third locking member is located intermediate the first locking member and the at least a second locking member, and the third locking member is coupled to the translation member through a slot or a plurality of openings in the translation member or are magnetically engaged to the translation member and configured to translate along the longitudinal axis of the translation member.

8. The universal adjustable breaker lock device of claim 1, wherein the first locking member or the at least second locking member or translation member are formed from a single continuous piece of material selected from the group consisting of steel, stainless steel, copper, aluminum alloy, polyethylene, polyvinyl chloride, and polypropylene.

9. The universal adjustable breaker lock device of claim 1 further comprising a cover member with at least one aperture disposed therethrough attached to the lever arm of the first locking member and the second lever arm of the at least second locking member.

10. The universal adjustable breaker lock device of claim 9, wherein the cover member is adapted to receive a lock member disposed through the at least one aperture, such that engaging the lock member with the cover member prevents removal of the device from the switch handle, when the channel is engaged with the switch handle.

* * * * *